US007111565B2

(12) United States Patent
Schoppe

(10) Patent No.: US 7,111,565 B2
(45) Date of Patent: Sep. 26, 2006

(54) ROTATING GRATE FOR THE COMBUSTION OF SLAG PRODUCING FUEL

(76) Inventor: Fritz Schoppe, Max-Rüttgers-Strasse 24 D-82057, Icking (DE)

( * ) Notice: Subject to any disclaimer, the term of this patent is extended or adjusted under 35 U.S.C. 154(b) by 0 days.

(21) Appl. No.: 11/076,756

(22) Filed: Mar. 10, 2005

(65) Prior Publication Data

US 2005/0199164 A1 Sep. 15, 2005

(30) Foreign Application Priority Data

Mar. 15, 2004 (DE) ..... 10 2004 012 900

(51) Int. Cl.
*F23J 15/00* (2006.01)
*F23J 1/00* (2006.01)
*F23G 7/00* (2006.01)

(52) U.S. Cl. ..... 110/345; 110/259; 110/165 R

(58) Field of Classification Search ..... 110/345, 110/230, 259, 165 R, 214, 246; 432/103, 432/105; 48/76, 113
See application file for complete search history.

(56) References Cited

U.S. PATENT DOCUMENTS 3,577,941 A * 5/1971 Schoppe ..... 110/246
3,599,581 A * 8/1971 Schoppe ..... 110/158
4,598,649 A * 7/1986 Eshleman ..... 110/211
5,785,516 A * 7/1998 Tanaka ..... 432/118

FOREIGN PATENT DOCUMENTS

| | | |
|---|---|---|
| DE | 1 526 077 | 2/1970 |
| DE | 1 751 457 | 7/1971 |
| DE | 2 046 337 | 4/1972 |
| EP | 0 952 396 | 10/2003 |
| JP | 60 221612 A | 11/1985 |

* cited by examiner

*Primary Examiner*—Kenneth Rinehart
(74) *Attorney, Agent, or Firm*—Bliss McGlynn, P.C.

(57) ABSTRACT

In a rotating grate having a rotational-symmetrical shape having an axis of rotation which is inclined against a horizontal plane by more than 34°, and which encloses a combustion chamber for the combustion of slag-forming fuel, which is locked on a lower end and is open at an upper end and is defined by meridionally extending carrier arms that are hollow and are connected to a compression air source and are provided with blow openings directed into the combustion chamber, the combustion chamber has a spherical shape, or in the borderline case a cylindrical shape with a radially extending lower front side, the angle of inclination of the axis of rotation against the horizontal is between 36° and 46°, the carrier arms in the combustion chamber are flush with the remaining grate surface, and the inner contour of the combustion chamber encloses an angle of 90° with the axis of rotation in the area of the closed end. Thereby, an intense circulation of the combustible on the rotating grate is caused in operation, which avoids the formation of slag adhering to the grate.

15 Claims, 2 Drawing Sheets

ROTATING GRATE FOR THE COMBUSTION OF SLAG PRODUCING FUEL

FIELD OF THE INVENTION

Figure 1:
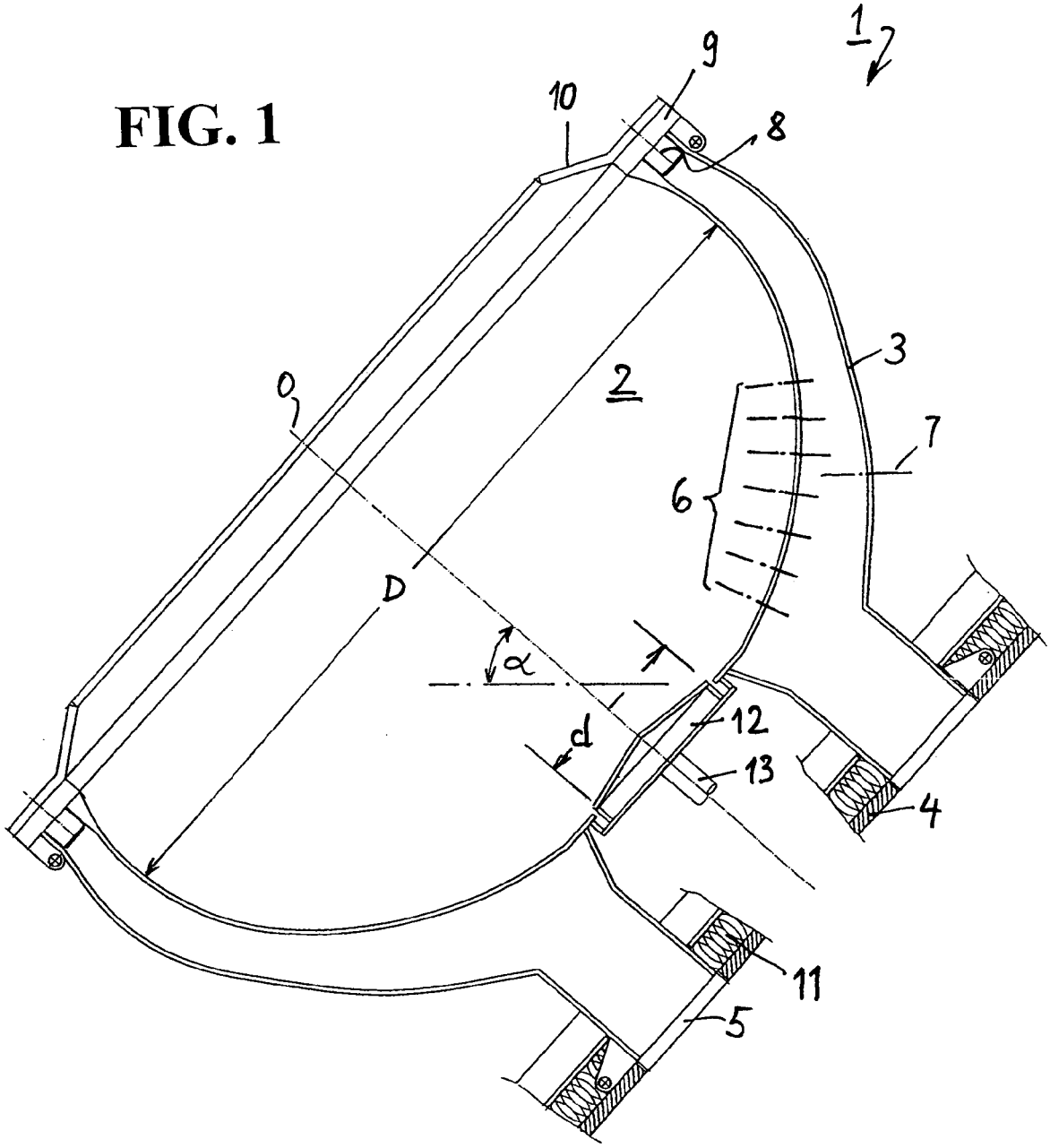

The invention refers to a rotating grate and a method of combusting slag producing fuel, and in particular to a rotating grate having a rotational-symmetrical shape and including an axis of rotation which is inclined by more than 34° against a horizontal, said grate enclosing a combustion chamber defined by a rotating body which is closed at a lower end and is open at an upper end, and which is delimited by hollow, meridionally extending carrier arms having each a hollow space which is connected to a common compression air source, said carrier arms being each provided with blow openings directed into the combustion chamber. The invention further refers to a method of operation a rotating grate of the aforementioned type.

BACKGROUND OF THE INVENTION

Almost all solid fuels or combustibles include incombustible components, which after combustion remain as ash and which mostly have very high melting temperatures. If these components remain on a combustion grate in a more or less moved way for a prolonged prior of time under the effect of the flame temperature, eutectic reactions might occur between the components within the slag, wherein the melding temperature of the mixture of these components significantly drops. Softening or melt flow of the mixture takes place, thus the formation of adhesive or viscous slag with uncombusted parts often being included. If moreover the movement of the combustible on the grate is low, large slag lumps are formed that affect the operation of the rotating grate.

The movement conditions are essential to prevent such states. If the combustible is kept in constant and sufficient movement, the time during which two ash components are in contact is not sufficient for the relatively slow eutectic reactions, and slag and lumps cannot form. The combustion air supply and the local temperatures controlled thereby are also influential.

A suitable combustion air supply suffered so far at rotating grates, as it is for instance described in DE 2 046 337 A, DE 1 526 077 C and DE 1 751 457 A, since in these grates the combustion air is blown from below against a sphere-like grate. In such rotating grates it is not possible to convey a greater portion of the supplied air into the combustible. The grate rods and the combustible resting thereon block the air blow from below against the rotating grate. Thus, only a partial combustion in the lowermost layer of the combustible lying on the rotating grate takes place with the respective local excess temperatures and the flow of slag.

It was reported that in the case of practically designed constructions for instance in a manner as shown in DE 2 046 337 A, the slag flow in cooperation with the flames of the air burning below the rotating grate attacked the carrier structure of the grate and destroyed it within few weeks of operation. This was the reason for the fact that grate combustions did not become accepted.

A rotating combustion gate as defined in the opening portion of this specification is disclosed in EP 0 952 396 B1, this document showing a conical combustion grate or combustion cone comprising hollow, meridionally extending carrier arms for the purpose of supplying combustion air supplied from a compressed air source directly into the combustion chamber. However, the carrier arms project from the grate surface on the combustion chamber side, since they are supposed to cooperate in the agitation of the combustible. Moreover, it is relied on the separation effect that is produced in hollow conical bodies of this type and arrangement (axial inclination 35° to the horizontal) and which effects that the fine portion of the combustible separates from the agitated main mass of same and travels to the smaller diameter of the cone. This should intensify combustion.

This separation effect was actually produced in the known combustion cone and, thanks to the novel type of combustion air supply, the combustion results were very good. Unfortunately, the separated fine portion of the ash hardly moved at the small diameter of the rotating combustion cone, and thus the formation of slag took place. Furthermore, the sections of the carrier arms projecting into the combustion chamber obstructed a circulating movement of the combustible on its support.

SUMMARY OF THE INVENTION

It is therefore the object of the invention to provide a rotating grate of the above-mentioned kind that it prevents an interfering slag generation during operation and a method which is suitable for operating such a rotating grate.

According to the invention, a rotating grate is provided having a rotational-symmetrical shape and including an axis of rotation which is inclined by more than 34° against a horizontal, said grate enclosing a combustion chamber defined by a rotating body which is closed at a lower end and is open at an upper end, and which is delimited by hollow, meridionally extending carrier arms having each a hollow space which is connected to a common compression air source, said carrier arms being each provided with blow openings directed into the combustion chamber. In accordance with the invention, the combustion chamber has a spherical shape, or in the borderline case a cylindrical shape with a radially extending lower end side, the angle of inclination of the axis of rotation with respect to the horizontal is between 36° and 46°, the carrier arms in the combustion chamber are flush with the remainder of grate surface, and an inner contour of the combustion chamber in an area of the closed end encloses an angle of 90° with the axis of rotation.

During the search for a remedy for the above-mentioned problems, the inventor built rotary grate models of different shapes, such as spheres, rotational ellipsoids, cylinders, cones etc. A strange effect was detected:

a) in the case of sphere-like shapes (also in the case of rotational ellipsoids) of the rotating grate, and b) if the cylindrical zone changes over at the large diameter D (compare later FIG. 1) with a possibly large radius into the small diameter d, and c) if the surface at the small diameter is possibly perpendicular to the axis of rotation, and d) if the inclination of the axis of rotation against the horizontal is between 36° and 46°, optimally at 42°, a surprisingly large speed of circulation of solid combustible lying on the grate surface is produced in the area of the small diameter, which is even significantly larger than the circumferential speed of the rotating grate.

The difference between said speed of circulation of the solid combustible and the speed of rotation of the rotating grate has a distinct maximum value at an angle of inclination of 42° of the axis of rotation against the horizontal, and significantly reduces at smaller and larger angles of inclination. Below 36° and above 42° the difference disappears almost completely.

The essential factor for achieving this circulating movement of the combustible is that the surface of the grate carrying the combustible does not have any defective portions in the form of projections, as was the case in the combustion cone shown in EP 0 952 396 B1, in which the meridionally extending hollow carrier arms together with interposed filling bodies (grate rods) form a relatively corrugated surface, since there the carrier arms should advance the agitation, and blow openings formed on the carrier arms shall also blow laterally into the combustible. In contrast thereto, the carrier arms of the rotating grate of the invention are flush with the grate surface so that no obstacles result for the circulation of the combustible on the grate.

If the rotating grate tapers in the direction towards its open end by not less than 20% starting from its largest diameter, a favourable retaining behaviour of the rotating grate for the combustible moved thereon results for the respective angle of inclination of the axis of rotation.

The blow openings are distributed and dimensioned on the hollow carrier arms preferably according to the layer thickness to be locally expected of the combustible lying on the rotary grate. In this manner, an air supply is achieved whose quantity is adapted to the quantity of the combustible to be supplied with combustion air. Thus, favourable exhaust gas values are obtained and local overheating is prevented. Measures are preferably also taken by which 20% to 40%, preferably 28% to 30% of the entire combustion air is supplied as underblast air to these meridionally extending arms of the rotary grate that are covered by combustible. A portion of the combustion air is supplied as overfire air by the carrier arms that are not covered by the combustible for the purpose of cooling same. Cooled-down combustion gas can be added to the overfire air for the purpose of a temperature control.

The invention will now be explained with reference to the embodiments shown in the drawings.

SHORT DESCRIPTION OF THE DRAWINGS

Figure 2:
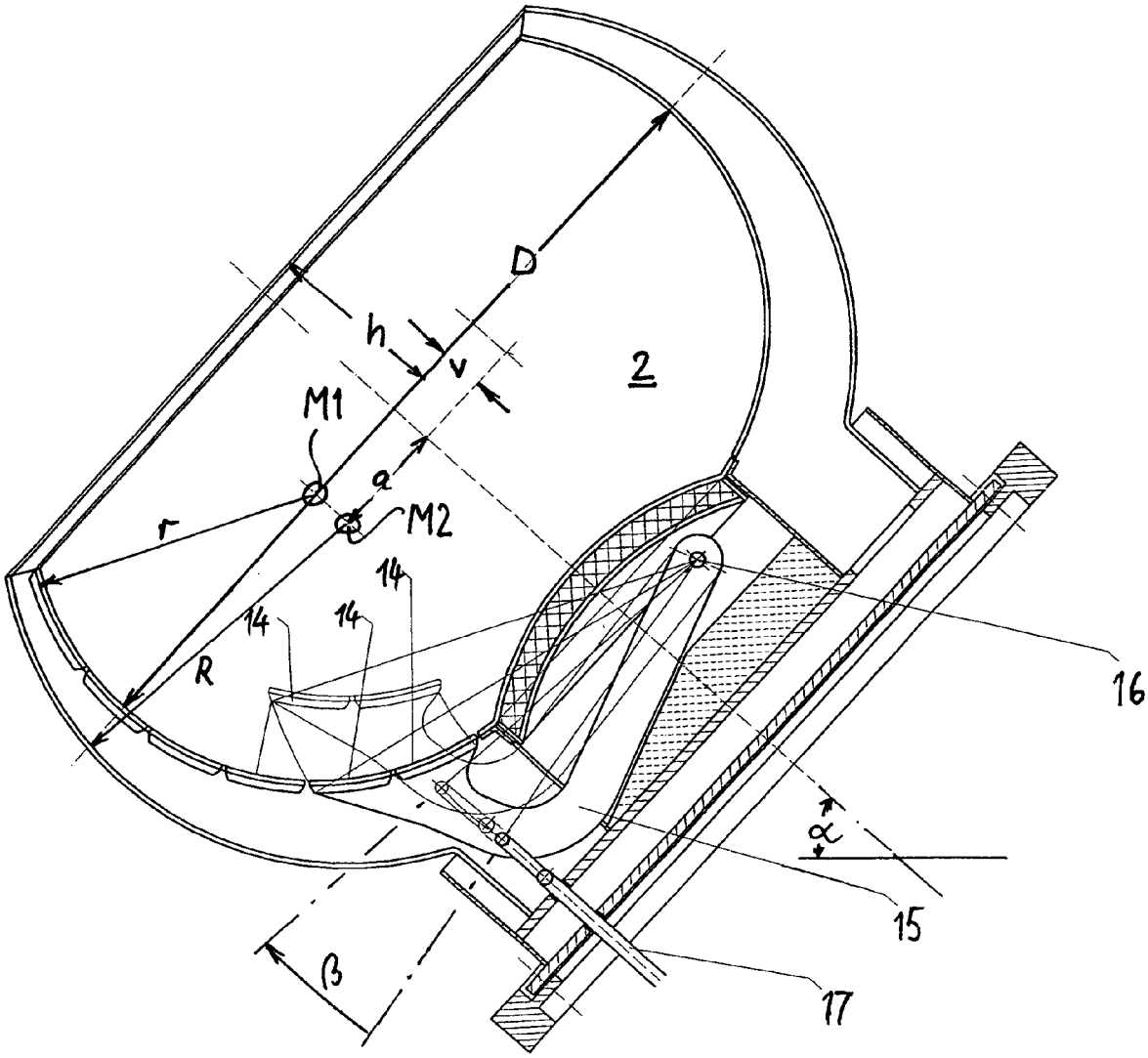

FIG. 1 thematically shows in the axial section a first embodiment of the invention, and FIG. 2 shows in a similar view a second embodiment of the invention.

DETAILED DESCRIPTION OF A PREFERRED EMBODIMENT

FIG. 1 shows a rotating grate according to the invention, which comparable to the combustion cone according to EP 0 952 396 B1 is rotatably supported in a frame, which for reasons of clarity is not shown, since it is not required for explaining the features distinguishing the invention over EP 0 952 396 B1. Also any driving means for rotating the grate are not shown in the drawing. In this and other respects, reference is made to said EP 0 952 396 B1, the contents thereof is included herein by reference. The rotating grate, which is totally designated by 1, is held in the frame, which is not shown, in a manner that its axis of rotation O includes an angle $\alpha$ of 42° in the example shown against the horizontal.

The rotating grate 1 encloses a combustion chamber 2, which in the example shown has approximately the shape of a rotation ellipsoid. The combustion chamber 2 has a large inner diameter D and is delimited by meridionally extending, hollow carrier arms 3, which are held on a base plate and which hold multi-part grate rods, see in this respect the already mentioned EP 0 952 396 B1. The base plate 4 has supply openings 5 that are connected to the inner space of the carrier arms 3 and to which a compression air source, which is not shown, is connected. In the carrier arms 3 blow bores 6 directed against the combustion chamber 2 are formed, which are schematically shown in FIG. 1 with dash-dotted lines and through which the combustion air can be blown as underblast air into the combustible (not shown) lying on the grate. Furthermore, a few blow openings 7 are formed on the side of the carrier arms 3 opposing the combustion chamber 2, through which blow air can be blown into an ash box (not shown) located below the rotating grate.

On their free end situated in the area of the opening of the combustion chamber 2, each of the carrier arms 3 is provided with an opening, through which cooling air can be blown against a carrier ring 9 at which the carrier arms 3 end. The carrier ring 9 is covered by a protective cone 10 on its side opposing the combustion chamber 2, said protective cone 10 protecting the carrier ring 9 against the influence of heat of an after-burner chamber, which is not shown, which in practice is arranged above the rotating grate 1 and which shall not be described here any further.

To protect the carrier plate 4 against the heat dissipated by the rotating grate, a heat insulation 11 is attached on the base plate 4.

A central bottom of the rotary grate 1 located in the axis O is formed by a movable cover 12 having a small diameter d. The movable cover 12 is held by a shaft 13 by the aid of which the cover 12 can be moved in an axial direction. As an alternative, it is also possible to support the cover on one side by means of a hinge (not shown) at the rotating grate 1 so that it can be opened by a pivot movement. By the rotating movement of the rotating grate, ash located on the cover can be withdrawn through the opening exposed by the cover 12 when the cover 12 is opened.

By suitable measures, which are not shown, the air supply to the carrier arms 3 during operation of the rotating grate 1 is controlled such that the underblast air is supplied only to those carrier arms 3 whose bores 6 are covered by combustible. In the case of a total of 18 carrier arms 3, there are only five carrier arms through which combustion air is supplied as underblast air to the combustible lying on the rotating grate. This underblast air represents approximately 20 to 40%, preferably 28 to 30% of the entire amount of air required for the total combustion. Regarding details, how the selective, temporally changing supply of the carrier arms 3 with combustion air can be attained, reference is made to the above-mentioned EP 0 952 396 B1.

The remaining 60% to 80% of the entire combustion air is supplied to the flame that is located in and on the combustible. A part of these 60% to 80% can be supplied through the carrier arms 3 not covered by the combustible, which at the same time cools these carrier arms in an advantageous manner. The balancing amount of combustion air, according to the invention 20% to 40%, preferably 25% to 35% of the total air amount, is supplied to the combustion in the usual manner as overfire air.

To control the temperature of the carrier arms, an approximately equal amount of return gas, that is returned, cool gas, is supplied to the overfire air. This portion may be 20% to 40% of the entire combustion air amount.

An alternative embodiment is shown in FIG. 2 according to which some segments 14 of adjoining grate rods are attached on a common pivot arm 15, which can be pivoted at an angle β around a pivot axis 16 supported on the rotating grate 1 by the aid of a thrust rod 17 in a manner that the segments 14 open into the combustion chamber 2. FIG. 2 shows the closed position of the segments 14 with full lines, whereas the open position is shown with phantom lines.

For a firing power of 22 MW, a rotating grate of the described type has the following dimensions for the combustion of waste wood having dimensions of an edge length of up to 155 mm:

| | |
|---|---|
| Large diameter D: | 3,760 mm |
| Opening diameter at the end of arms 3: | 3,500 mm |
| Small diameter d | 1,020 mm |
| Axial length of the combustion chamber from the cover 12 to the edge of the cone 10: | 1,900 mm |
| Opening diameter of the cone: | 2,970 mm. |

For other firing powers the rotating grate 1 is converted in a geometrically similar way according to the relation:

$$N=k\times D^{2.}$$

wherein k is a constant that depends on the combustible.

With the design of the combustion chamber 2 shown, agitation movements of the combustible on the rotating grate 1 result at an angle of inclination α of 42° the axis of rotation of the rotary grate 1 with respect to the horizontal, which are highly intense. In these agitation movements, the combustible does not only tumble on the rotating grate to turn the lower side upside down, but is also carries out a circulating movement around an imaginary axis, that extends approximately perpendicular to the surface defined by the circulating combustible. The speed of this circulating movement has a distinct maximum at said angle of inclination of 42°.

In the prior art, the inner contour of the rotary grate 1 was composed of straight pieces, particularly to simplify manufacture. The resulting bends between the individual surface sections did, however, visibly affect the agitation movement. According to the invention, the inner surface of the combustion chamber 2 is preferably continuously smooth, without any bends and pockets, as shown in the drawing. The angle of inclination α may deviate from 42°, but preferably not by more than 6° downwards or 4° upwards, since otherwise the effect of the circulating movement of the combustible on the rotating grate striven for is affected.

Compared to the formerly constructed conical rotary grates, such as in EP 0 952 396 B1, the spherical shape according to the invention does not only have the advantage that no slag residues are formed on the grate in case of proper operation, but also that the storage capacity of the spherical shape is approximately 2.0 to 2.2 times greater than in the conical shape. That means that the dwelling time of the combustible on the rotary grate 1 is correspondingly longer, i.e. bigger pieces (wood waste etc.) can be combusted than it was formerly possible, or the combustion efficiency is 1.5 to 1.7 times higher than in the conical shape while the pieces have the same size.

The difference in the storage capacity can well be demonstrated with models of the same diameter but different shape (spherical or conical).

The embodiment according to FIG. 2 is determined for a combustion efficiency of 20 MW for the combustion of brown coal briquettes of an edge length of 50 mm. It has the following dimensions:

| | |
|---|---|
| Large diameter D: | 3,200 mm |
| Radius of curvature r of the carrier arms inside (in the combustion chamber), with a curvature center M1 lying on the greatest diameter: | 1,145 mm |
| Curvature center M2 offset in the direction towards the bottom of the combustion chamber 2 | 1,380 mm |
| Distance a of both curvature centers M1 and M2 from the axis of the rotary grate O: | 456 mm |
| Distance h of the rotary grate opening from the position of the largest diameter D: | 621 mm |
| Number of grate rods between adjoining carrier arms: | 6 |

For other sizes of rotating grates, these dimensions are converted proportionally. The number of grate rods between the carrier arms 3 is not included by this. This number must be chosen such that grate rods of a length of 300 mm to 400 mm result. Smaller lengths are also appropriate, however, they increase the construction effort and costs. Greater lengths make the grate more sensitive against heat tensions.

If for instance the rotating grate shall be dimensioned for a power of 8 MW for the combustion of the same combustible, the following calculation is made:

$$N_1/N_2=(D_1/D_2)^{2.5}$$

Given $N_1$=20 MW and $N_2$=8 MW as well as $D_1$=3,200 mm, the result is: D2=2,218 mm.

The number of carrier arms 3 must preferably be chosen such that the clear distance between the carrier arms 3 in the area of the largest diameter D is between 300 mm and 500 mm. In the case of greater distances, the air supply to the combustible increases, since distances between the blow openings 6 and the combustible result which are too large. In the case of smaller distances, the construction effort and costs unnecessarily increase.

The invention claimed is:

1. A rotating grate for the combustion of slag producing combustibles, having a rotational-symmetrical shape having an axis of rotation which is inclined by an angle of inclination of more than 34° against a horizontal plane, and which encloses a combustion chamber which is closed at a lower end and is open at an upper end and has an inner grate surface which is delimited by hollow, meridionally extending carrier arms which each have a hollow space which is connected to a common compression air source, each said carrier arm being provided with blow openings directed into the combustion chamber, wherein a) the combustion chamber has one of a spherical shape and, in a borderline case, a cylindrical shape having a radially extending lower end side, b) the angle of inclination of the axis of rotation against the horizontal is between 36° and 46°, c) the carrier arms in the combustion chamber are flush with a remainder of the inner grate surface, and d) the combustion chamber has an inner contour which in an area of the closed lower end encloses an angle of about 90° with the axis of rotation.

2. A rotating grate as claimed in claim 1, wherein the angle of inclination is approximately 42°.

3. A rotating grate as claimed in claim 1, wherein the blow openings are distributed and dimensioned along the carrier arms in accordance with a respective layer thickness of the combustible lying on the inner grate surface.

4. A rotating grate as claimed in claim 1, comprising a discharge means for removing combustion residue from the combustion chamber.

5. A rotating grate as claimed in claim 3, comprising discharge means for removing combustion residue from the combustion chamber.

6. A rotating grate as claimed in claim 4, wherein the discharge means consists of a cover having a small diameter of the rotary grate and supported in a manner as to be displaceable into the combustion chamber.

7. A rotating grate as claimed in claim 4, wherein the discharge means consist of grate rods attached to a common, pivotally supported carrier, said grate rods being displaceable into the combustion chamber by means of said carrier.

8. A rotating grate as claimed in claim 4, wherein the discharge means consist of grate rods attached to a common, pivotally supported carrier lever so as to be moved by means of said carrier lever out of their position closing gaps between adjoining carrier arms of the rotating grate towards the outside.

9. A rotating grate as claimed in claim 1, comprising the following dimensions to achieve a power of 20 MW of the combustion of brown coal briquettes:

| | |
|---|---|
| Largest inner diameter | D = 3,200 mm |
| Radius of curvature internal | r = 1,145 mm |
| Small inner diameter | d = 1,350 mm |
| Distance between the largest inner diameter D and the opening of the combustion chamber (2): | h = 261 mm. |

10. A rotating grate as claimed in claim 8, wherein for powers other than 20 MW, the following formula applies to the dimensions of the grate $$Q=K\times D^{2.5}$$

wherein k is a constant that depends on the type of combustible.

11. A method of operating a rotating grate for the combustion of slag producing combustibles, having a rotational-symmetrical shape having an axis of rotation which is inclined by an angle of inclination of more than 34° against a horizontal plane, and which encloses a combustion chamber which is closed at a lower end and is open at an upper end and has an inner grate surface which is delimited by hollow, meridionally extending carrier arms which each have a hollow space which is connected to a common compression air source, each said carrier arm being provided with blow openings directed into the combustion chamber, and wherein the combustion chamber has one of a spherical shape and, in a borderline case, a cylindrical shape, having a radially extending lower front side, the angle of inclination of the axis of rotation against the horizontal is between 36° and 46°, the carrier arms in the combustion chamber are flush with a remaining grate surface, and the combustion chamber has an inner contour which encloses an angle of about 90° with the axis of rotation in an area of the closed lower end, said method comprising supplying 30% to 40% of combustion air required for a complete combustion of the combustible as underfire blast to the hollow spaces of the carrier arms which are covered by the combustible.

12. A method as claimed in claim 10, wherein a portion of the combustion air is supplied as overfire aire by the carrier arms that are not covered by the combustible.

13. A method as claimed in claim 11, wherein a portion of the combustion air is supplied as overfire aire by the carrier arms that are not covered by the combustible.

14. A method as claimed in 12, wherein cooled combustion gas is added to the overfire air.

15. A method as claimed in 13, wherein cooled combustion gas is added to the overfire air.

* * * * *